US006997068B2

(12) United States Patent
DiTrolio

(10) Patent No.: US 6,997,068 B2
(45) Date of Patent: Feb. 14, 2006

(54) FOOT-OPERATED PIPETTE DISPENSER

(75) Inventor: Nicholas M. DiTrolio, Havertown, PA (US)

(73) Assignee: Drummond Scientific Company, Broomall, PA (US)

( * ) Notice: Subject to any disclaimer, the term of this patent is extended or adjusted under 35 U.S.C. 154(b) by 58 days.

(21) Appl. No.: 10/632,458

(22) Filed: Jul. 31, 2003

(65) Prior Publication Data

US 2004/0074318 A1 Apr. 22, 2004

Related U.S. Application Data

(60) Provisional application No. 60/399,809, filed on Jul. 31, 2002.

(51) Int. Cl.
*B01L 3/02* (2006.01)

(52) U.S. Cl. ..... 73/864.14; 73/864.01; 73/864.15; 422/99; 422/100

(58) Field of Classification Search ..... 73/863.31, 73/863.32, 864–864.25; 422/99, 100
See application file for complete search history.

(56) References Cited

U.S. PATENT DOCUMENTS 3,310,002 A * 3/1967 Wilburn ..... 73/864.15
3,691,844 A * 9/1972 Moore ..... 73/864.15
4,041,764 A * 8/1977 Sabloewski et al. ..... 73/864.14
4,475,666 A * 10/1984 Bilbrey et al. ..... 222/14
4,598,840 A * 7/1986 Burg ..... 222/135
5,616,871 A * 4/1997 Kenney ..... 73/864.14
6,240,791 B1 * 6/2001 Kenney ..... 73/864.14
6,254,832 B1 * 7/2001 Rainin et al. ..... 422/100
6,734,026 B1 * 5/2004 Kenney ..... 436/180

OTHER PUBLICATIONS

"Pulse Width Modulation", available on the Internet at <http://www.cpemma.co.uk>.*
"Gundfos Pump Solutions", available on the Internet at <http://www.gundfos.com>.*
"Pulse Width Modulation DC Motor Control", available on the Internet at <http://www.aaroncake.net>.*

* cited by examiner

*Primary Examiner*—Hezron Williams
*Assistant Examiner*—David A. Rogers
(74) *Attorney, Agent, or Firm*—Joseph M. Konieczny, Sr.

(57) ABSTRACT

A pipette dispenser unit having a hand-held pipette dispenser having a pipette connector and a handle, a source of positive and negative air pressure in fluid connection with said pipette connector, and a foot-operated controller for regulating the flow of air between said air pressure source and said pipette connector. A method of metering fluid through a pipette by connecting the pipette to the pipette dispenser, holding the dispenser with one hand, and controlling fluid flow through the pipette by operating the controller with at least one foot.

18 Claims, 7 Drawing Sheets

FOOT-OPERATED PIPETTE DISPENSER

FIELD OF THE INVENTION

The present invention relates to a pipette dispenser with remote means to control fluid flow from the pipette. More particularly, the invention relates to a pipette dispenser having foot pedals that control the flow of fluid into and out of the pipette.

BACKGROUND OF THE INVENTION

On an average day, a technician may meter hundreds of fluid samples using a pipette dispenser such as the pipette gun taught by Kenney in U.S. Pat. No. 4,624,147, incorporated herein by reference. The pipette gun is operated by depressing one of the two finger-operated triggers to draw fluid into the pipette or expel fluid from the pipette.

Over time, repetitive depression of the pipette gun triggers can cause fatigue and/or repetitive movement injury in the technician's fingers and/or hand. Once a technician develops a repetitive stress or repetitive movement injury in his fingers or hands, the technician may not be able to operate a pipette gun without experiencing pain and/or discomfort. In very serious cases, the technician may be completely unable to operate the pipette gun and thus, not be able to perform his job. Therefore, it would be desirable to provide a pipette dispenser that can be operated in a manner other than by depressing finger triggers on the handle of the dispenser.

While using a pipette dispenser during the performance of various tasks, a technician repetitively raises and lowers the pipette dispenser with his arm. Depending on the length of the pipette, the height of the technician, and the task to be performed over time, the range of motion required by the technician's arm may be great enough to cause discomfort or injury. Therefore, in order to minimize repetitive motion or repetitive stress injury in the technician's arm, it would be desirable to provide a pipette dispenser having a handle that is adjustable in length so that the range of motion of the technician's arm during a particular task can be adjusted for the technician's comfort.

SUMMARY OF THE INVENTION

The present invention provides a pipette dispenser unit comprising a hand-held pipette dispenser having a pipette connector and a handle, a source of positive and negative air pressure in fluid connection with the pipette connector, and a foot-operated controller for regulating the flow of air between the air pressure source and the pipette connector. The controller includes at least one foot-operated control pedal that throttles air between the air pressure source and the pipette connector. In a preferred embodiment, the controller includes a first foot-operated control pedal that controls positive air pressure and a second pedal that controls negative air pressure.

The controller includes a microcontroller, a potentiometer connected to each pedal, and a plurality of valves connected to the air pressure source. The microcontroller uses pulse width modulation at a pre-programmed frequency to selectively open and close the valves. The microcontroller activates the air pressure source only after a preprogrammed threshold signal limit has been received from one of the foot pedals. The air pressure source is preferably located proximate the remote, foot-operated controller.

The pipette dispenser may comprise a gun-type dispenser having a barrel supporting the pipette connector and a lengthwise-adjustable handle connected to the barrel so that the distance between the handle and the barrel is adjustable. The handle includes a hand grip and a plurality of telescoping support members.

The present invention also provides a method of metering fluid through a pipette. A pipette dispenser unit having a hand-held pipette dispenser with a pipette connector and a handle, a source of positive and negative air pressure in fluid connection with the pipette connector, and a foot-operated controller for regulating the flow of air between said air pressure source and said pipette connector is initially provided. A pipette is connected to the pipette dispenser, which is held by hand by a technician. The technician then controls the flow of fluid through the pipette by operating the controller with at least one foot. The technician may also adjust the length of the handle of the dispenser.

The present invention also provides a hand-held pipette dispenser comprising a barrel, a pipette connector fixed to one end of the barrel, and an extendable handle fixed to the other end the barrel. The handle has a hand grip and a telescoping support member connecting the hand grip to the barrel.

DETAILED DESCRIPTION OF PREFERRED EMBODIMENTS

Figure 1:
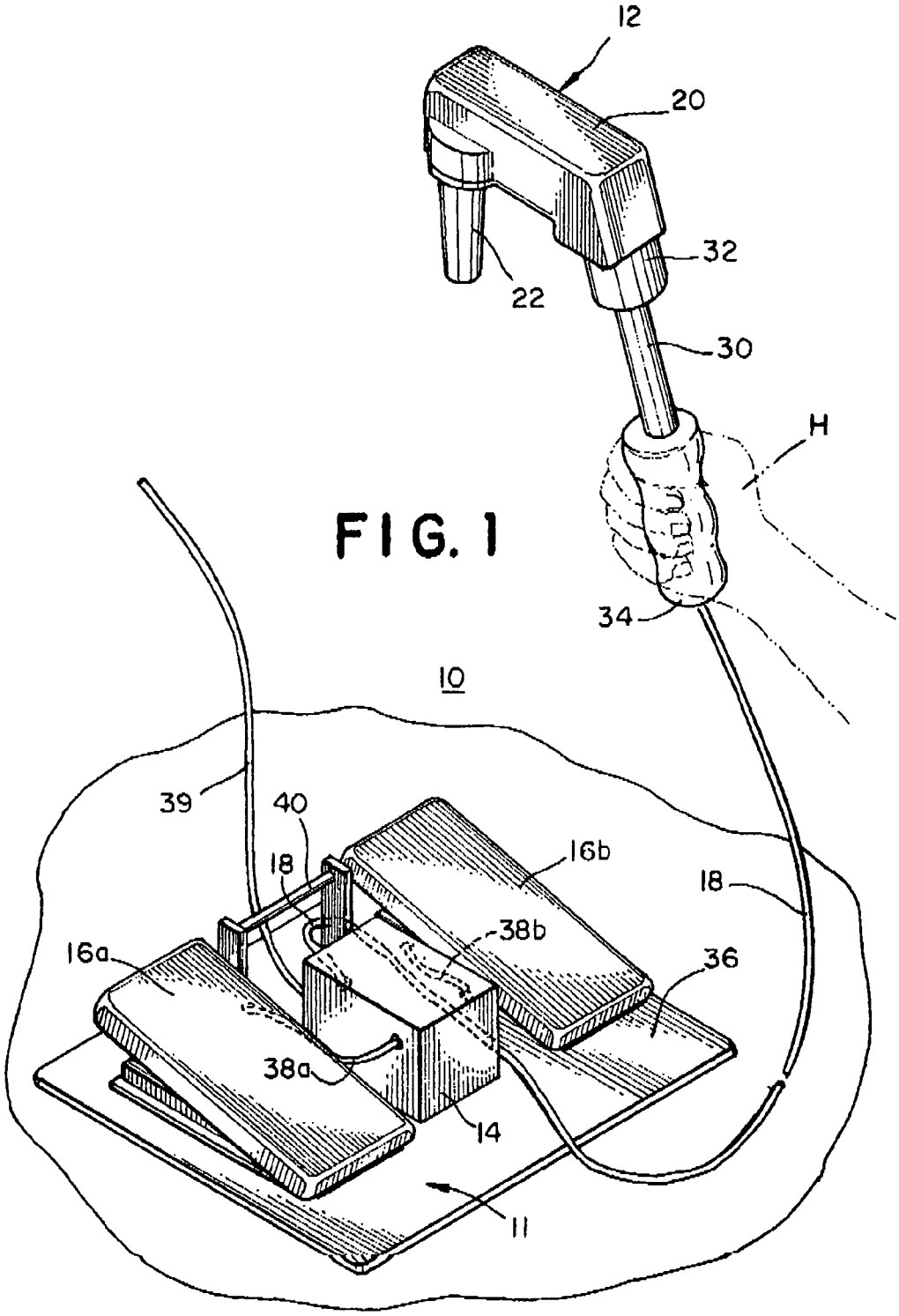
FIG. 1 is a perspective view of a foot-operated pipette dispenser unit in accordance with an embodiment of the invention.

Preferred embodiments of the invention are described below with reference to FIGS. 1–8 wherein like reference numerals are used throughout to designate like elements.

An embodiment of the foot-operated pipette dispenser unit of the present invention, designated generally by reference numeral 10, is illustrated in FIG. 1. The dispenser unit 10 generally comprises a hand-held pipette dispenser 12, a source of positive and negative air pressure 14, and a foot-operated controller that controls the flow of air between the air pressure source 14 and the pipette dispenser 12.

Figure 3:
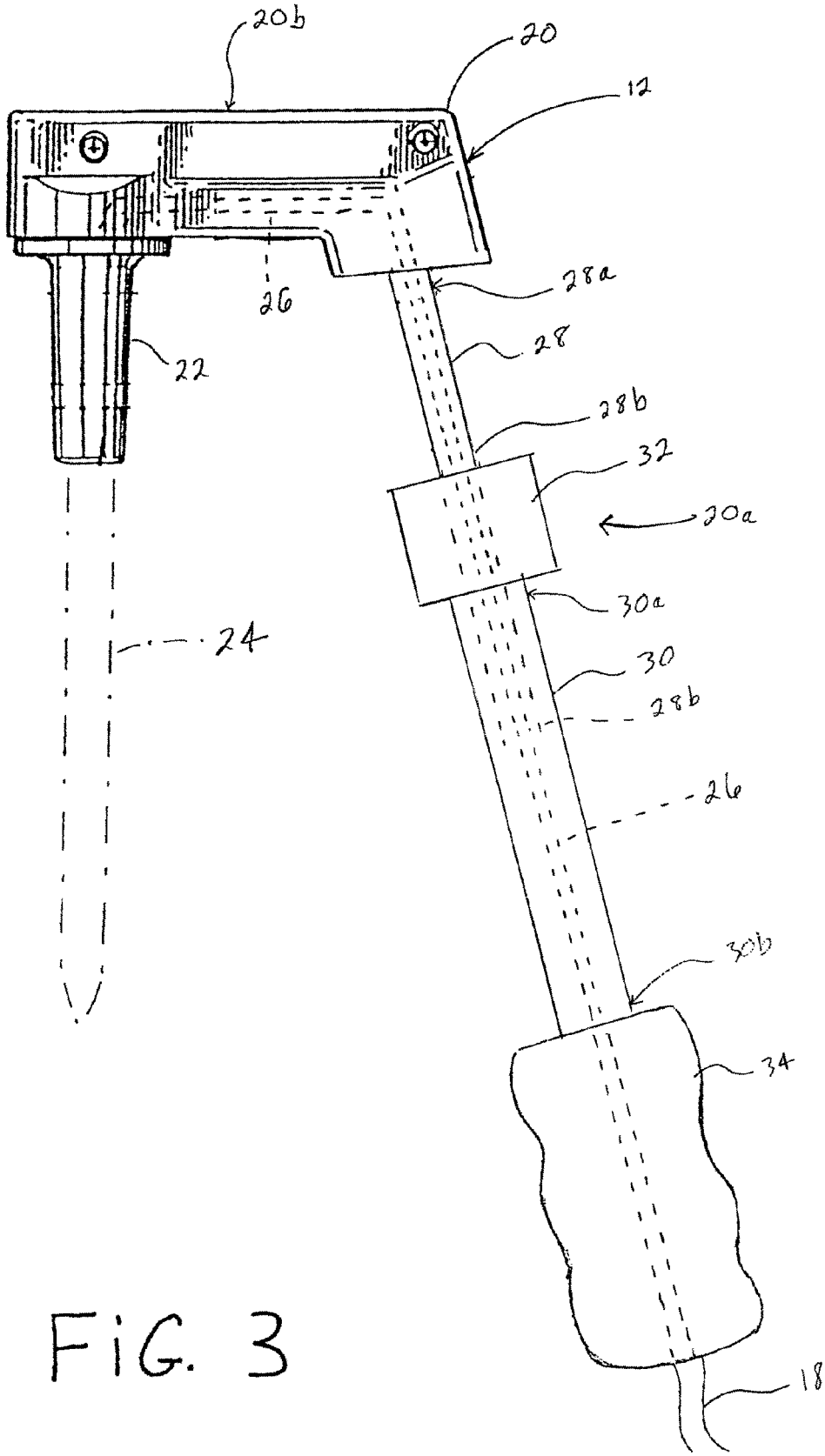
FIG. 3 is a side elevation of the pipette holder of the pipette dispenser unit shown in FIG. 1.

In a preferred embodiment, the hand-held pipette dispenser 12 comprises a pipette gun-type dispenser 12 having a housing 20 with an adjustable hand grip 20*a* and a barrel 20*b* oriented transverse to the hand grip 20*a* as best seen in FIG. 3. A pipette connector 22 is fixed to and oriented downwardly transverse to the barrel 20*b*. However, it should be appreciated by one of ordinary skill in the art that the hand-held pipette dispenser could comprise various other types of dispensers without departing from the scope of the present invention.

The pipette connector 22 is constructed and arranged to removably attach pipettes 24 of various lengths and diameters. The pipette connector 22 is connected in fluid communication to the air pressure source via an internal conduit 26 and an external flexible conduit 18.

Referring to FIG. 3, the handle 20*a* of the pipette holder preferably includes hollow, telescoping support members 28, 30. The first support member 28 is fixed at its upper end 28*a* to the barrel 20*b* of the pipette holder 12. The other end 28*b* of the first support member 28 telescopes into and out of the second support member 30. A locking mechanism 32 is fixed to the upper end 30*a* of the second support member 30. A hand grip 34 is fixed to the lower end 30*b* of the second support member 30. The locking mechanism 32 may be, for example, a cam or twist-lock mechanism. The hand grip 34 may be integrally formed with the second support member 30 or may be applied over the lower end 30*b* of the second support member 30.

In a preferred embodiment, the dispenser unit 10 includes a source of positive and negative air pressure that is connected in fluid communication to, but is remote from, the pipette dispenser housing 20. In other words, the air pressure source 14 is not mounted on or within the pipette dispenser housing 20. However, it should be appreciated by those of ordinary skill in the art that the air pressure source could be located on or in the pipette dispenser housing 20 without departing from the scope of the invention.

Figure 6:
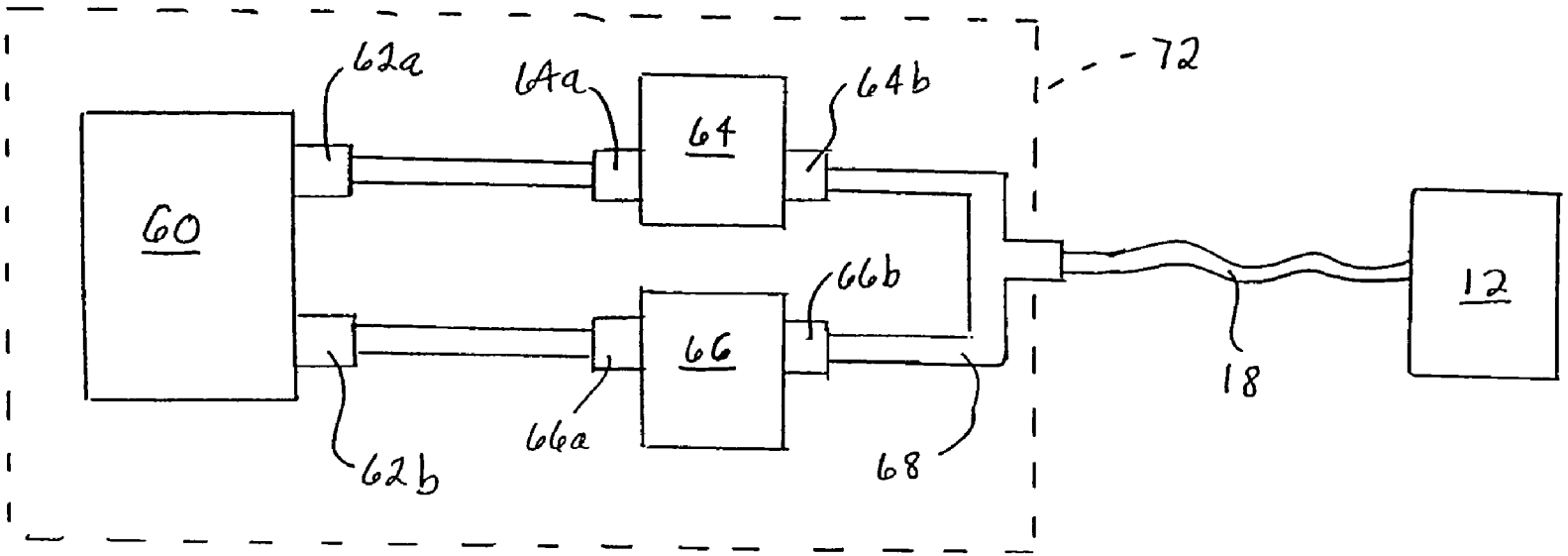
FIG. 6 is a pneumatic schematic diagram of the pump and valves of the remote air pressure source of the pipette dispenser unit shown in FIG. 1.

Referring to FIG. 6, the remote air pressure source 14 generally comprises a diaphragm pump 60 having a negative pressure port 62*a* and a positive pressure port 62*b*. A first valve 64 is connected to the negative pressure port 62*a* at its input. A second valve 66 is connected to the positive pressure port at its input. The output ports 64*b*, 66*b* of the valve 64, 66, respectively, are connected to a T-shaped manifold 68, which is connected to an external, flexible conduit 18. The pump 60, valves 64, 66 and manifold are contained in a housing 72, which is mounted to the base plate 36 of a remote unit 11.

A microcontroller 70 selectively opens and closes the valves 64, 66 to control the direction (positive or negative air pressure) of air flow through the flexible conduit 18 and the volume of air through the conduit 18. Each valve 64, 66 includes a vent, which opens when the opposite valve is open to prevent the pump 60 from stalling.

In another embodiment of the invention, the pump 60 could be a rotary vane pump. In this embodiment, the parallel valve arrangement shown in FIG. 6 is not needed since the flow of air through the conduit 18 can be reversed by simply reversing the rotation of the rotary vane pump. Further, the volume of air flow through the conduit can be controlled by varying the speed of rotation of the rotary vane pump.

Figure 2:
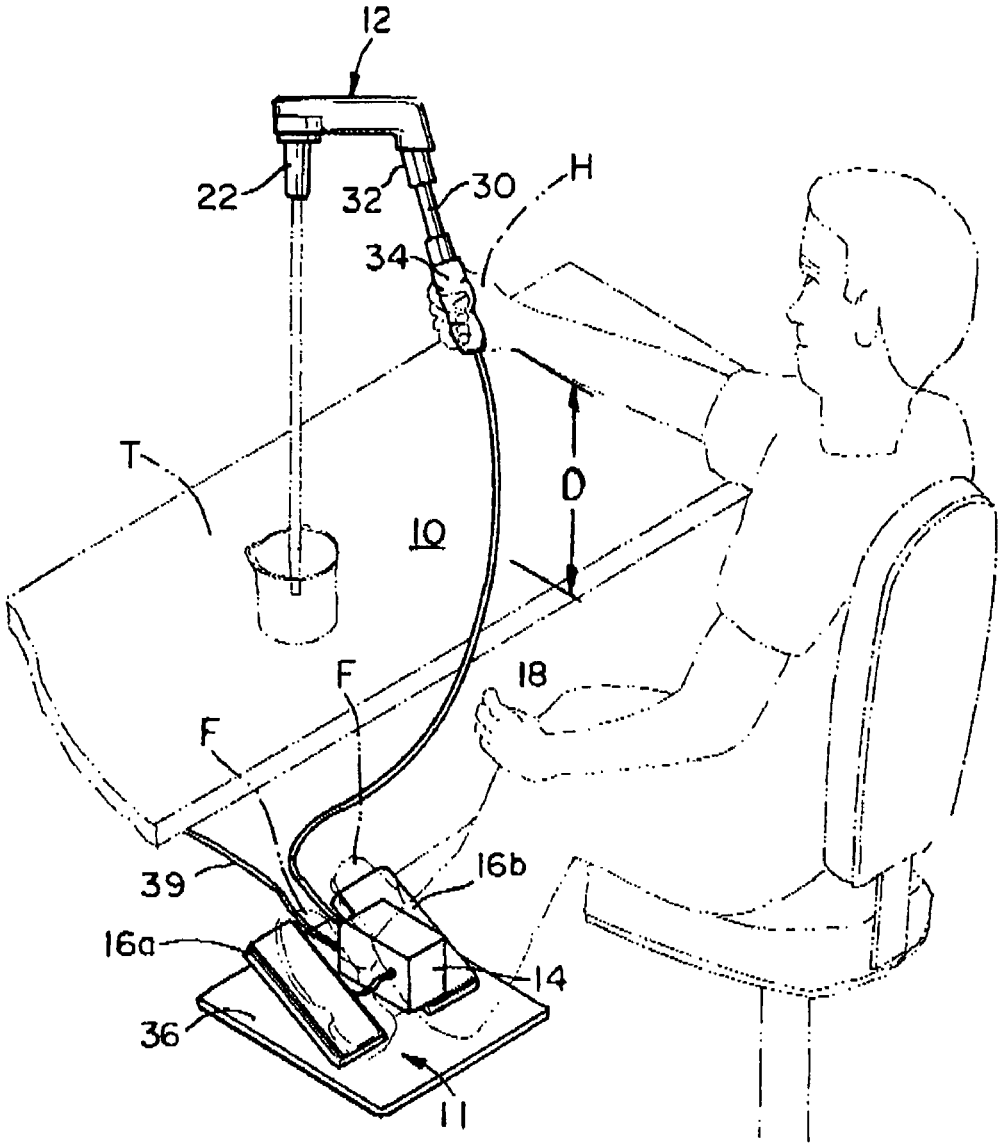
FIG. 2 is a schematic view of a technician using the pipette dispenser of FIG. 1.

Referring to FIG. 2, a pair of foot-operated control pedals 16*a*, 16 are mounted on a base plate 36 on opposed sides of the air source 14. The foot pedals 16*a*, 16*b* are electrically connected to the air pressure source 14 by wires 38*a*, 38*b*, respectively. In a preferred embodiment, a handle 40 is fixed to the base plate 36 for easy transport of the unit 11.

Figure 4:
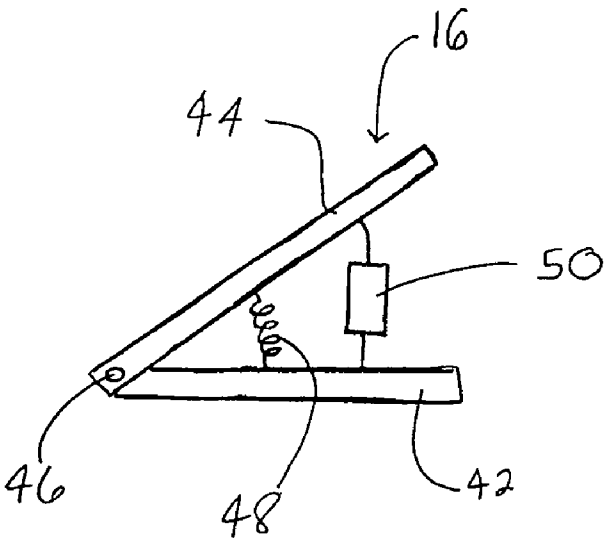
FIG. 4 is schematic illustration of a foot pedal of the pipette dispenser unit shown in FIG. 1.

Referring to FIG. 4, each foot pedal comprises a base 42 and a foot plate 44, which is rotatably connected to the base 42 by a pin or axle 46. A compression spring 48 is fixed between the base 42 and the foot plate 44. The compression spring 48 urges the foot plate 44 upwardly (or counterclockwise in FIG. 4) relative to the base 42. Depression of the foot plate 44 by a technician compresses the spring 48 until the downward force of the technician's foot is removed, whereafter the compression spring 48 urges the foot plate 44 back upwardly. A potentiometer 50 is connected intermediate the base 42 and the foot plate 44. As described below with reference to FIGS. 5 and 6, the potentiometer allows the technician to control the rate of fluid flow through the pipette 24 by controlling the distance the foot pedal is depressed. In the embodiment illustrated in FIG. 2, the foot pedals comprise potentiometer foot controls manufactured by Linemaster Switch Corporation, Woodstock, Conn., model number 09ASAC. In other embodiments of the invention, a less expensive foot control may be provided.

Figure 8:
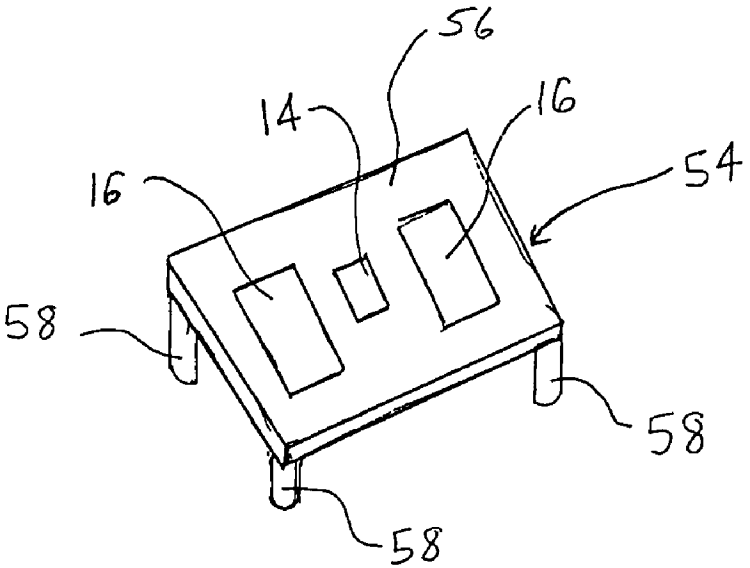

In another embodiment illustrated in FIG. 8, the foot pedals 16 and remote air pressure source 14 may be mounted on a foot rest 54 comprising a base plate 56 and adjustable legs 58. In a further embodiment, the foot pedals 16 may be constructed so that depression of the heel or rotation of the foot of the technician initiates the control/throttle mechanisms of the apparatus 10. For added comfort, the foot plate 44 of the foot pedal 16 may be padded or custom formed for the technician.

Figure 5:
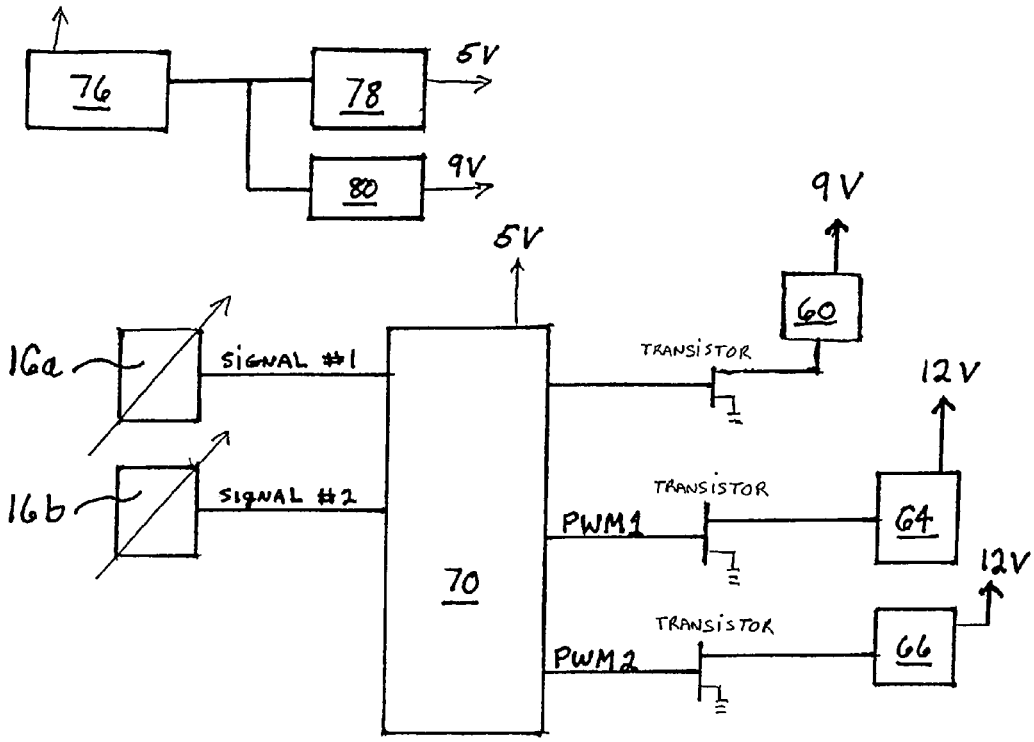
FIG. 5 is an electrical schematic diagram of the control system of the pipette dispenser unit shown in FIG. 1.

Referring to FIG. 5, the power supply 60 of the remote air pressure source 14 comprises a 12-volt AC/DC converter and is connected to a 5-volt regulator 78 and 9-volt regulator 80. The microcontroller 70 uses pulse width modulation to regulate the direction of flow (either positive pressure or negative pressure) and the volume of air to the pipette dispenser 12. During operation, the microcontroller 70 receives a signal from either the first foot pedal 16*a*, which controls negative air pressure, or from the second foot pedal 16*b*, which controls positive air pressure. The foot pedals 16*a*, 16*b* send signals of varying strength depending on the distance the foot pedal 16 is depressed. In this embodiment of the invention, the foot pedals 16*a*, 16*b* function in a manner similar to a throttle.

The microcontroller 70 is programmed to switch on the pump 60 only after a preprogrammed threshold signal limit is received from one of the foot pedals 16. In other words, the microcontroller will not turn on the pump 60 until one of the foot pedals 16*a*, 16*b* is depressed beyond a certain distance. Once the threshold limit is exceeded, the microcontroller activates the pump 60. In this embodiment, the output of the pump 60, in either the negative or positive pressure mode, is not in fluid connection with the pipette holder until one of the valves 64, 66 is opened.

The microcontroller uses pulse width modulation at a pre-programmed frequency to selectively open and close the valves 16*a*, 16*b* in response to the signal from the foot pedal 16*a*. The width of the pulse of the signal sent by the microcontroller 70 to one of the valves 16*a*, 16*b* determines the amount of time the valve is opened for a particular frequency. As the foot pedal is depressed further downwardly, the microcontroller 70 responds by keeping the valve open for a longer period of time per cycle. Depression and release of the foot pedal throttles the valve, which in turn controls the fluid flow rate into the pipette 24.

The frequency at which the microcontroller 70 operates will vary depending on the type of valve 64, 66 selected for the unit 10. For example, if the frequency is too high compared with the response time of the valve, the valve will not open and close properly. If the frequency is too low, the fluid flow rate through the pipette will be too slow and the flow will appear erratic to the technician. In the embodiment illustrated in FIGS. 5 and 6, the frequency of the output signal from the microcontroller 70 to the valves is 200 Hertz.

Figure 7:
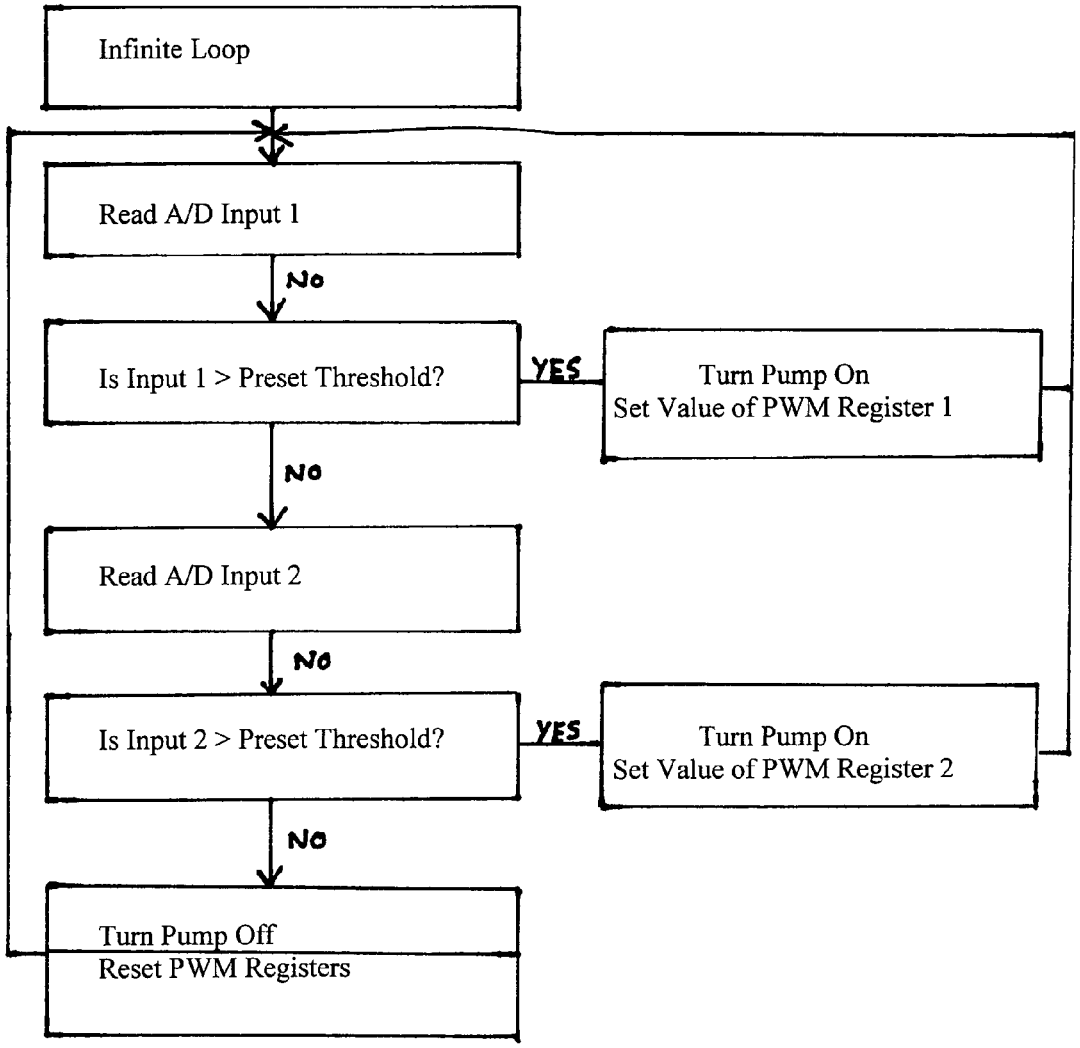
FIG. 7 is a flow chart of the operation of the microcontroller of the pipette dispenser unit shown in FIG. 1; and, FIG. 8 is a perspective view of a foot stand for mounting the foot pedals in accordance with an embodiment of the invention.

A flow chart illustrating operation of the microcontroller 70 is illustrated in FIG. 7. The input, output and pulse width modulation (PWM) registers are initialized by the microcontroller. In a preferred embodiment, the pulse width modulation time frame is set for 200 Hz. The timer is enabled to allow the microcontroller to interrupt at the set period of time. The PWM registers are reset to zero. The microcontroller then operates in the infinite loop illustrated in FIG. 7. The algorithm of the A/D converter controls the speed of the valves 64,66 by inserting a value in the PWM register to control the duty cycle of the valves 64,66.

In the embodiment shown in FIGS. 1–8, the valve comprises and LHD Series Control Valve manufactured by The Lee Company, Westbrook, Conn., model number LHDX0502750BC. The microcontroller 70 may comprise model number PIC16C74 manufactured by Microchip Technology, Inc., Chandler, Ariz.

FIG. 2 illustrates a technician metering fluid into and out of a pipette 24 using the above-described dispenser unit 10. The technician can sit comfortably in a chair with one foot "F" resting on each foot pedal 16*a*, 16*b*. To admit fluid into the pipette 24, the technician depresses the vacuum pedal 16*a* until the desired volume of fluid enters the pipette 24. To expel fluid from the pipette 24, the technician depresses the positive pressure foot pedal 16*b* until the correct volume of fluid has been dispensed. Using the above-described apparatus, the technician avoids any repetitive movement injury in his hand "H" caused by repeatedly depressing the fingers of a conventional pipette dispenser.

In accordance with the method of the invention, the technician may also extend or retract the handle 20*a* of the pipette holder 12 to reduce stress in the technician's arm. Referring to FIG. 2, a long pipette 24 is being used to meter fluid. In this example, the technician's hand "H" must be raised a distance "D" above the work surface T in order to admit or dispense fluid into the beaker 25. In order to reduce stress on the technician's arm and shoulder, the handle 20*a* can be extended beyond the length shown in FIG. 2 so that the technician's hand need only be raised a distance less than "D", thereby reducing stress on the technician's arm and shoulder. The length of the handle 12*a* of the pipette dispenser 12 can be adjusted to account for the varying heights of technicians, as well as the position (standing or sitting) of the technician while using the dispenser 12.

In comparison to conventional pipette dispensers, the foot controls of the present invention provide more sensitive fluid-flow control since the range of travel of the foot pedal is greater than the range of the finger trigger of a pipette gun. For example, the range of travel of the trigger of a pipette gun is approximately 7/16 in., whereas the range of travel of the foot pedal described above exceeds 1 inch.

It should be appreciated by one of ordinary skill in the art that various modifications can be implemented to the above-described embodiments, and that the foregoing shall be considered illustrative and that various modifications thereto will not depart from the scope and spirit of the invention. For example, the foot-operated controls may be implemented with hand-operated pipette dispensers other than the pipette-gun-type dispensers shown above.

What is claimed is:

1. A pipette dispenser unit, comprising:

a) a hand-held pipette dispenser having a pipette connector and a handle;

b) a source of positive and negative air pressure in fluid connection with said pipette connector; and, c) a foot-operated controller for regulating the flow of air between said air pressure source and said pipette connector, said controller including:

i) a microcontroller, ii) at least one foot-operated control pedal that throttles air between said air pressure source and said pipette connector;

iii) a potentiometer connected to said pedal, and iv) a plurality of valves connected to said air pressure source.

2. The pipette dispenser unit recited in claim 1, wherein said controller includes a first foot-operated control pedal that controls positive air pressure and a second pedal that controls negative air pressure.

3. The pipette dispenser unit recited in claim 1, wherein said air pressure source is located proximate said foot-operated controller.

4. The pipette dispenser unit recited in claim 1, wherein said handle is extendable from said dispenser.

5. The pipette dispenser unit recited in claim 1, wherein said microcontroller uses pulse width modulation at a preprogrammed frequency to selectively open and close said valves.

6. The pipette dispenser unit recited in claim 5, wherein said microcontroller activates said air pressure source only after a preprogrammed threshold signal limit has been received from one of the foot pedals.

7. The pipette dispenser recited in claim 1, wherein said pipette dispenser comprises a gun-type dispenser having a barrel supporting said pipette connector and a handle connected to said barrel.

8. The pipette dispenser unit recited in claim 7, wherein the distance between said handle and the barrel is adjustable.

9. The pipette dispenser unit recited in claim 8, wherein said handle includes a hand grip and a plurality of telescoping support members.

10. A pipette dispenser unit, comprising:

a) a hand-held pipette dispenser having a pipette connector and an adjustable handle, wherein the distance between said handle and said pipe connector is adjustable;

b) a remote source of positive and negative air pressure in fluid connection with said pipette connector; and c) foot-operated means for controlling the flow of air between said air pressure source and said pipette connector.

11. The pipette dispenser recited in claim 10, wherein said pipette dispenser comprises a gun-type dispenser having a barrel supporting said pipette connector and a an extendable handle connected to said barrel, said handle including a hand grip and a plurality of telescoping support members.

12. The pipette dispenser recited in claim 10, wherein said control means includes a first and second foot-operated control pedal that throttles air between said air pressure source and said pipette dispenser, said first foot-operated control pedal controlling positive air pressure and the second pedal controlling negative air pressure.

13. The pipette dispenser unit recited in claim 12, wherein said control means includes a microcontroller, a potentiometer connected to each pedal, and a plurality of valves connected to said air pressure source.

14. The pipette dispenser unit recited in claim 13, wherein said microcontroller uses pulse width modulation at a preprogrammed frequency to selectively open and close said valves.

15. The pipette dispenser unit recited in claim 14, wherein said microcontroller activates said air pressure source only after a preprogrammed threshold signal limit has been received from one of said foot pedals.

16. The pipette dispenser unit recited in claim 15, wherein said air pressure source is located proximate said foot-operated control means.

17. A method of metering fluid through a pipette, comprising the steps of:

a) providing a pipette dispenser unit having a hand-held pipette dispenser with a pipette connector and a lengthwise-adjustable handle, a source of positive and negative air pressure in fluid connection with said pipette connector, and a foot-operated controller for regulating the flow of air between said air pressure source and said pipette connector;

b) connecting a pipette to the pipette dispenser;

c) adjusting the length of the handle;

d) holding the dispenser with a hand; and, e) controlling fluid flow through the pipette by operating the controller with at least one foot.

18. A hand-held pipette dispenser, comprising a barrel, a pipette connector fixed to one end of said barrel, and an extendable handle fixed to the other end the barrel, said handle having a hand grip and a telescoping support member connecting said hand grip to said barrel.

* * * * *